US005143181A

United States Patent [19]

Bixby

[11] Patent Number: 5,143,181

[45] Date of Patent: Sep. 1, 1992

[54] PLATFORM LIFT APPARATUS

[76] Inventor: Lawrence B. Bixby, 17335 SE. 67th St., Rte. 2, Box 1671, Oklawaha, Fla. 32179

[21] Appl. No.: 772,327

[22] Filed: Oct. 7, 1991

[51] Int. Cl.[5] ..... B66B 9/20

[52] U.S. Cl. ..... 187/10; 187/19; 182/103; 182/141

[58] Field of Search ..... 187/19, 9 R, 10, 24, 187/25; 182/103, 141, 179; 414/448, 444

[56] References Cited

U.S. PATENT DOCUMENTS 3,313,376 4/1967 Holland, Sr. ..... 187/19
3,804,208 4/1974 Iida ..... 187/19
3,891,062 6/1975 Geneste ..... 187/10

*Primary Examiner*—Robert P. Olszewski
*Assistant Examiner*—Kenneth Noland
*Attorney, Agent, or Firm*—Leon Gilden

[57] ABSTRACT

An apparatus wherein a base plate mounts a plurality of base plate tubes, each mounting stabilizer legs, wherein the stabilizer legs are provided to include leveling screws to provide leveling of the associated apparatus relative to an underlying support surface. A guide track including a gear rack is arranged to cooperate with a drive gear structure rotatable by use of a reversing electric motor to effect raising and lifting of an associated platform in cooperation with the drive gear structure with the gear rack. An extension guide track, including an extension gear rack, is arranged to be affixed longitudinally aligned with the gear rack structure to effect extension of effective length for raising and lowering of the associated platform.

9 Claims, 7 Drawing Sheets

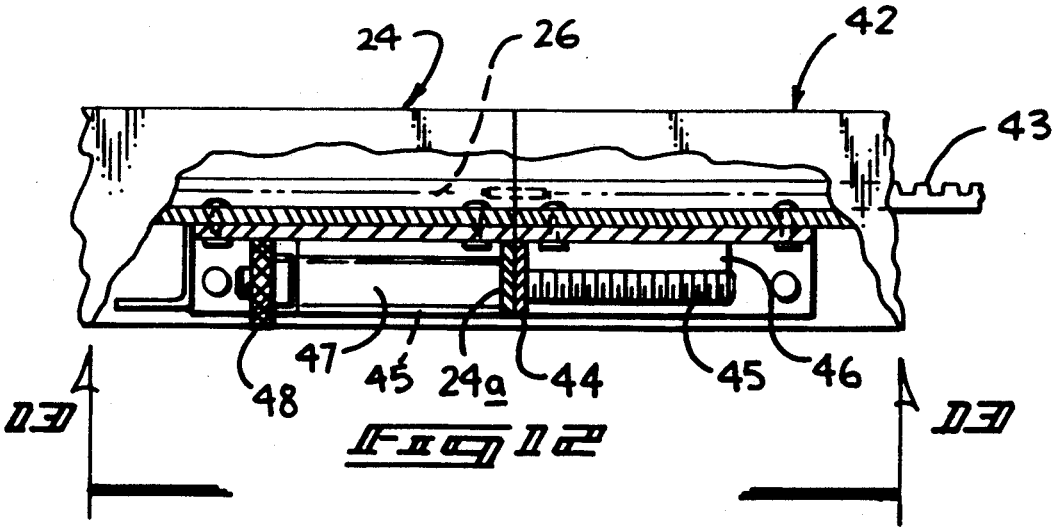
FIG 12
FIG 13
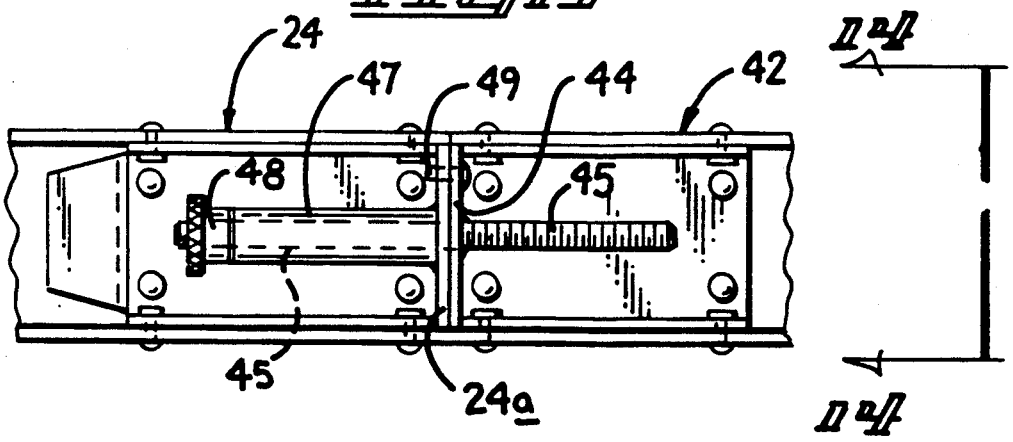
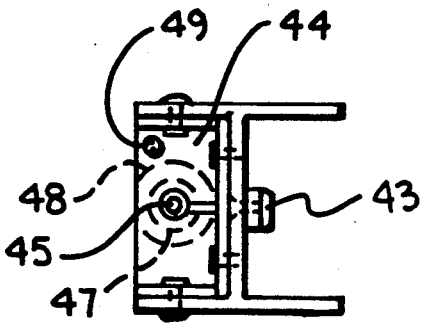
FIG 14

PLATFORM LIFT APPARATUS

BACKGROUND OF THE INVENTION

1. Field of the Invention

The field of invention relates to lifting apparatus, and more particularly pertains to a new and improved platform lift apparatus wherein the same is arranged for the selective raising and lifting of a platform for use in an elevator structure relative to an individual.

2. Description of the Prior Art

The raising and lifting of personnel relative to various work environments such as in a construction trade to permit raising and lowering of personnel and materials relative to an elevator orientation such as to transport roofing shingles for example relative to an elevated surface is typically of an arduous and time consuming proposition. Various patents utilized in the prior art to effect the motor driven use of lifting devices is set forth in U.S. Pat. Nos. 4,919,236; 4,768,621; 3,866,717; 3,924,710; 3,799,292; 4,440,266; 3,878,916; and 3,776,328.

Accordingly, it may be appreciated that there continues to be a need for a new and improved platform lift apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of platform lift apparatus now present in the prior art, the present invention provides a platform lift apparatus wherein the same permits ease of assemblage of an interfolded structure to permit a portable and compact lifting platform for use. As such, the general purpose of the present invention, which will be described subsequently in greater detail, is to provide a new and improved platform lift apparatus which has all the advantages of the prior art platform lift apparatus and none of the disadvantages.

To attain this, the present invention provides an apparatus wherein a base plate mounts a plurality of base plate tubes, each mounting stabilizer legs, wherein the stabilizer legs are provided to include leveling screws to provide leveling of the associated apparatus relative to an underlying support surface. A guide track including a gear rack is arranged to cooperate with a drive gear structure rotatable by use of a reversing electric motor to effect raising and lifting of an associated platform in cooperation with the drive gear structure with the gear rack. An extension guide track, including an extension gear rack, is arranged to be affixed longitudinally aligned with the gear rack structure to effect extension of effective length for raising and lowering of the associated platform.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved platform lift apparatus which has all the advantages of the prior art platform lift apparatus and none of the disadvantages.

It is another object of the present invention to provide a new and improved platform lift apparatus which may be easily and efficiently manufactured and marketed.

It is a further object of the present invention to provide a new and improved platform lift apparatus which is of a durable and reliable construction.

An even further object of the present invention is to provide a new and improved platform lift apparatus which is susceptible of a low cost of manufacture with regard to both materials and labor, and which accordingly is then susceptible of low prices of sale to the consuming public, thereby making such platform lift apparatus economically available to the buying public.

Still yet another object of the present invention is to provide a new and improved platform lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 12 is an orthographic view, taken along the lines 12—12 of FIG. 11 in the direction indicated by the arrows, partially in section.

FIG. 13 is an orthographic view, taken along the lines 13—13 of FIG. 12 in the direction indicated by the arrows.

FIG. 14 is an orthographic end view of the illustration as set forth in FIG. 13.

DESCRIPTION OF THE PREFERRED EMBODIMENT

Figure 1:
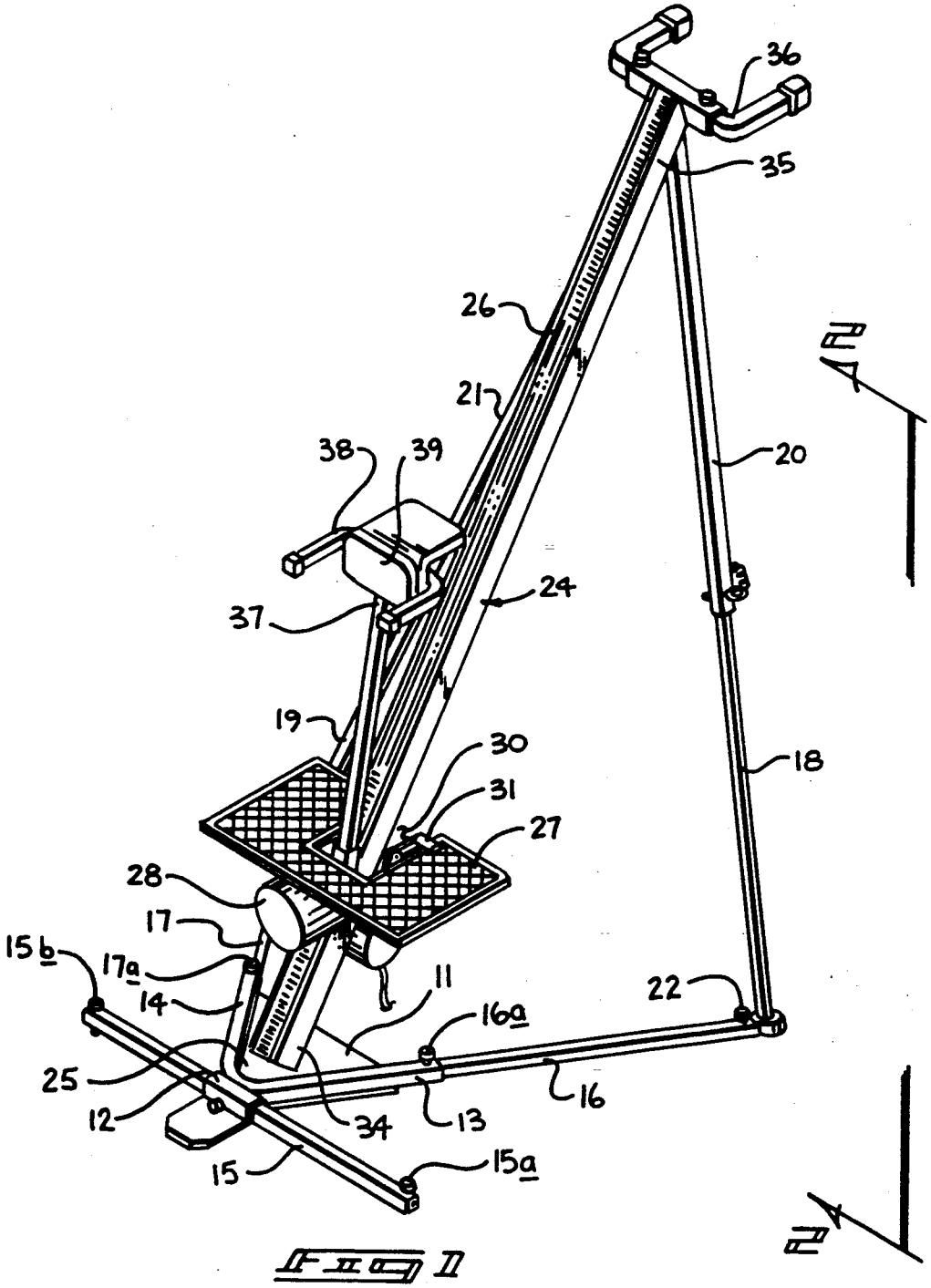
FIG. 1 is an isometric illustration of the instant invention.

With reference now to the drawings, and in particular to FIGS. 1 to 17 thereof, a new and improved platform lift apparatus embodying the principles and concepts of the present invention and generally designated by the reference numeral 10 will be described.

Figure 3:
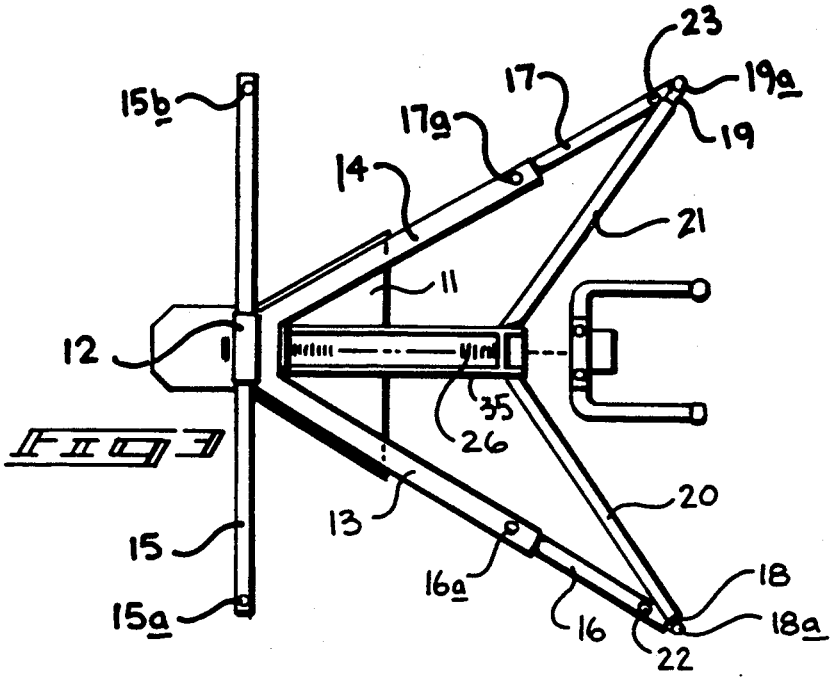
FIG. 3 is an orthographic view, taken along the lines 3—3 of FIG. 2 in the direction indicated by the arrows.
Figure 2:
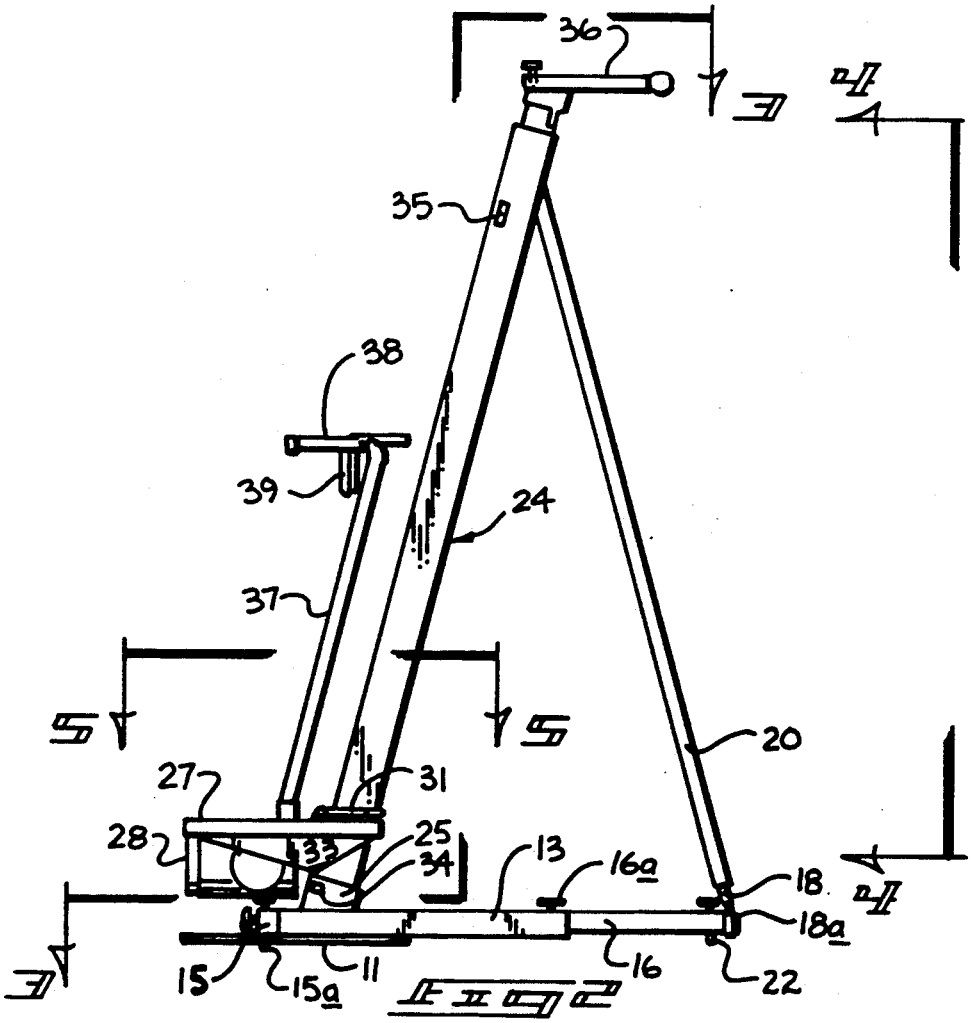
FIG. 2 is an orthographic view, taken along the lines 2—2 of FIG. 1 in the direction indicated by the arrows.
Figure 5:
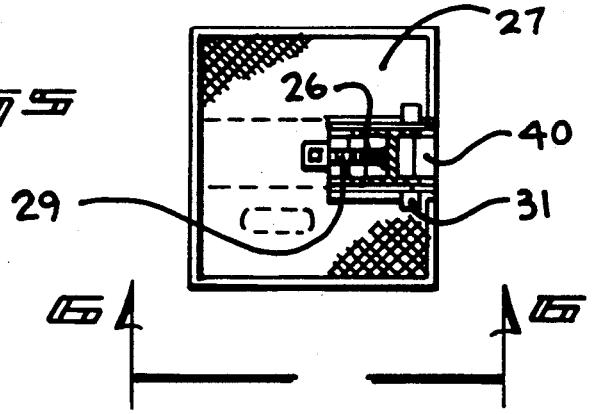
FIG. 5 is an orthographic view, taken along the lines 5—5 of FIG. 2 in the direction indicated by the arrows.
Figure 4:
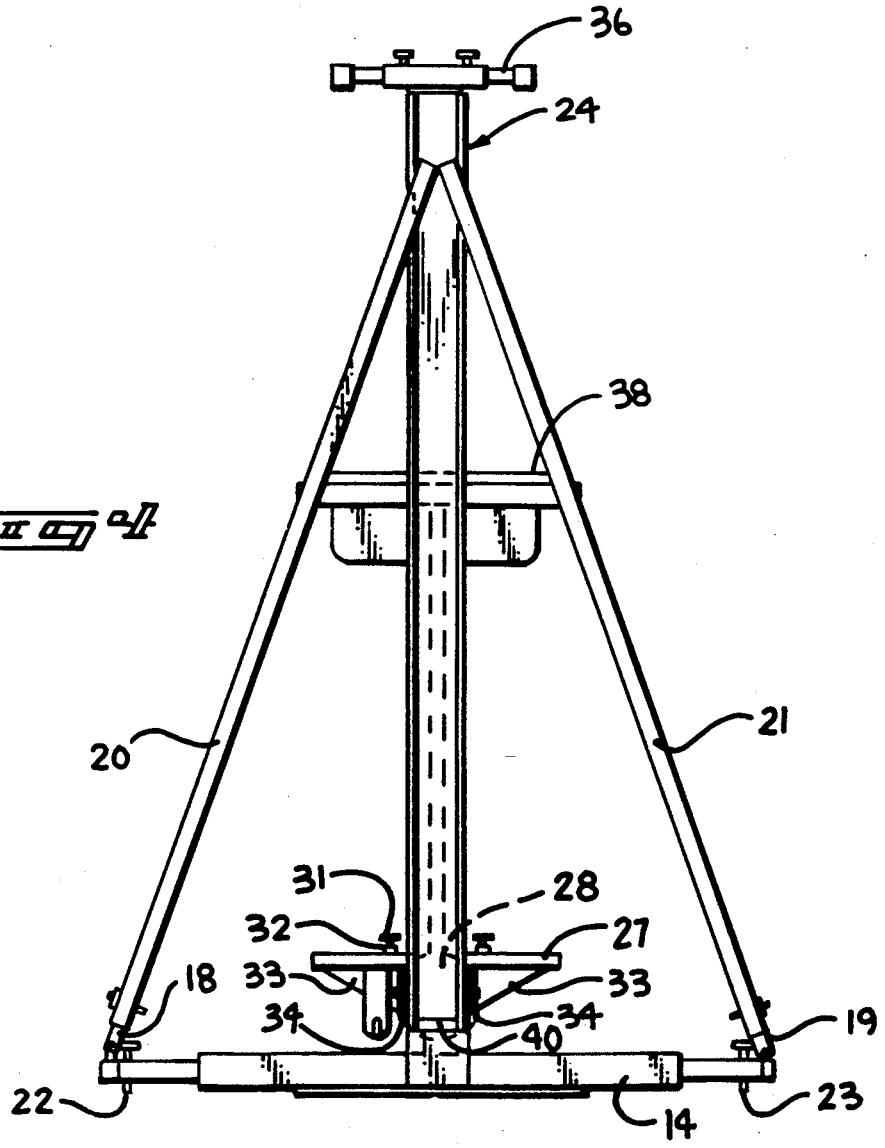
FIG. 4 is an orthographic view, taken along the lines 4—4 of FIG. 2 in the direction indicated by the arrows.
Figure 9:
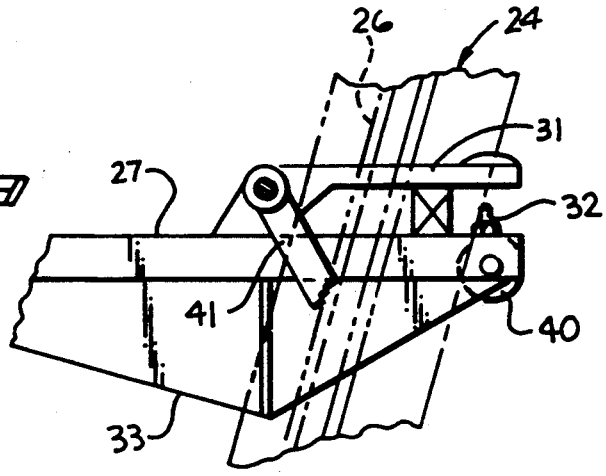
FIG. 9 is an orthographic view, taken along the lines 9—9 of FIG. 6 in the direction indicated by the arrows.
Figure 8:
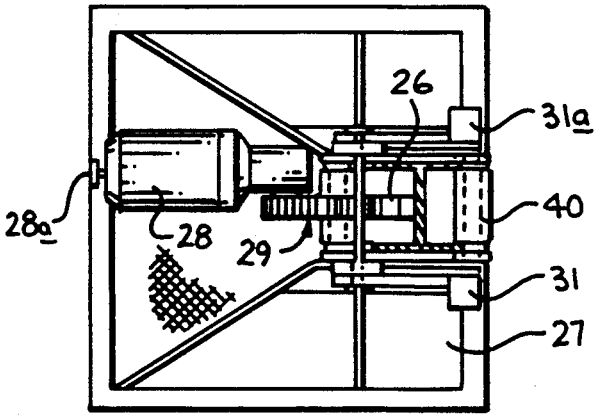
FIG. 8 is an orthographic view, taken along the lines 8—8 of FIG. 6 in the direction indicated by the arrows.
Figure 10:
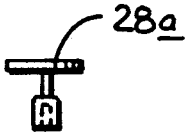
FIG. 10 is an orthographic view of the motor crank handle arranged for selective rotation of the crank motor in the advent of electrical power failure.
Figure 6:
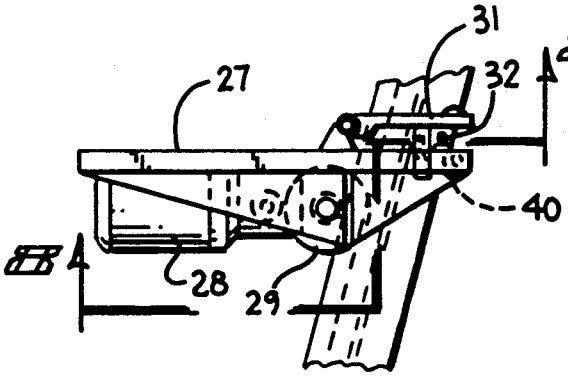
FIG. 6 is an orthographic view, taken along the lines 6—6 of FIG. 5 in the direction indicated by the arrows.
Figure 7:
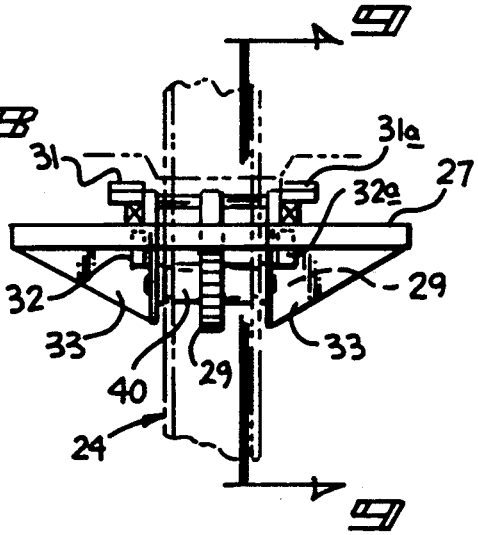
FIG. 7 is an orthographic front view of the lift platform structure mounted to the guide track.
Figure 11:
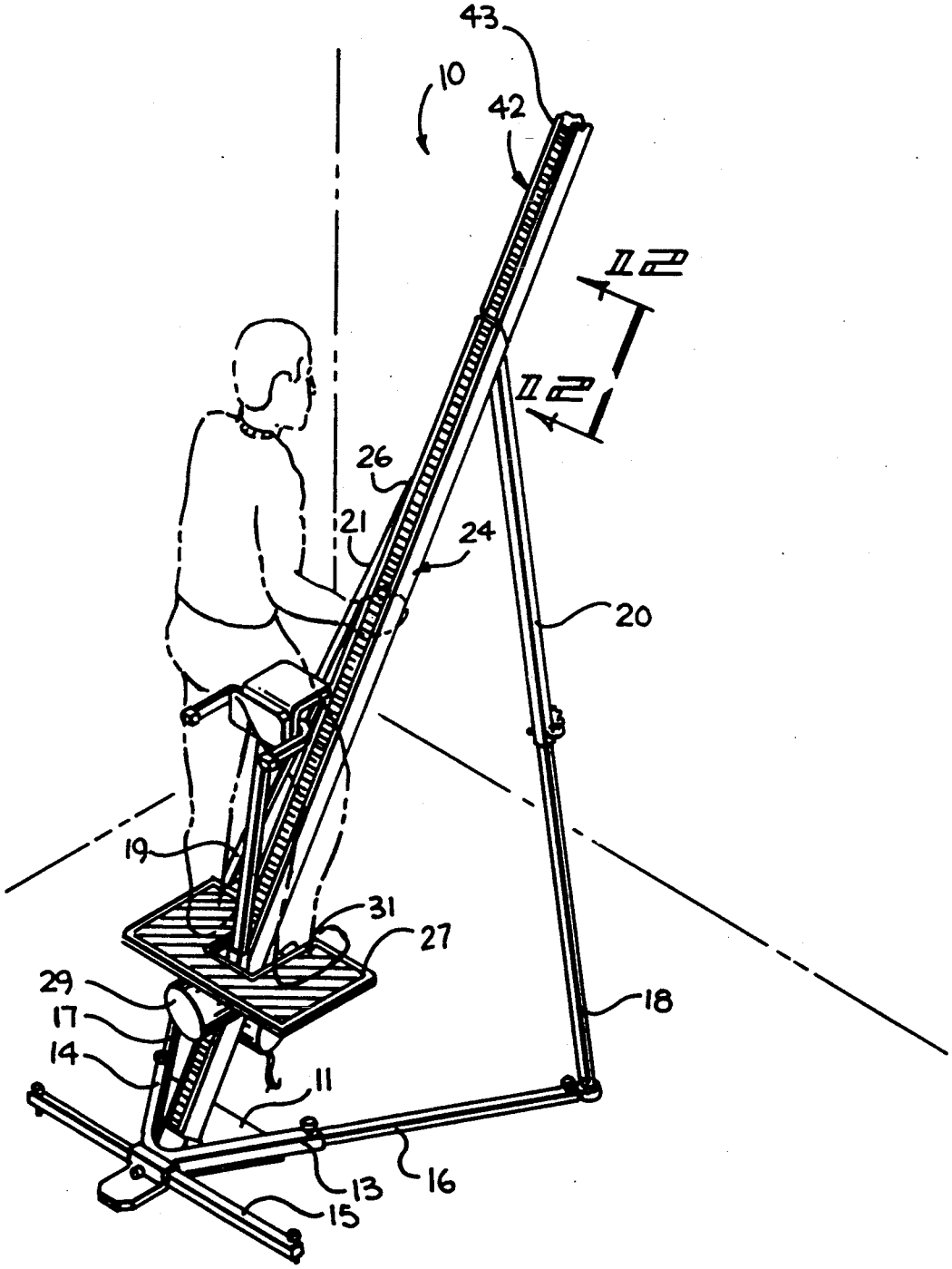
FIG. 11 is an isometric illustration of the apparatus including an extension guide track.
Figure 16:
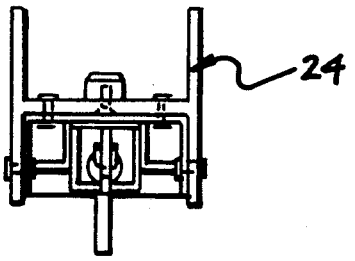
FIG. 16 is an orthographic end view, taken along the lines 16—16 of FIG. 15 in the direction indicated by the arrows.
Figure 17:
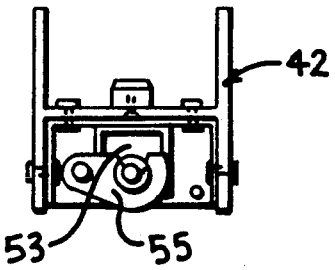
FIG. 17 is an orthographic view, taken along the lines 17—17 of FIG. 15 in the direction indicated by the arrows.
Figure 15:
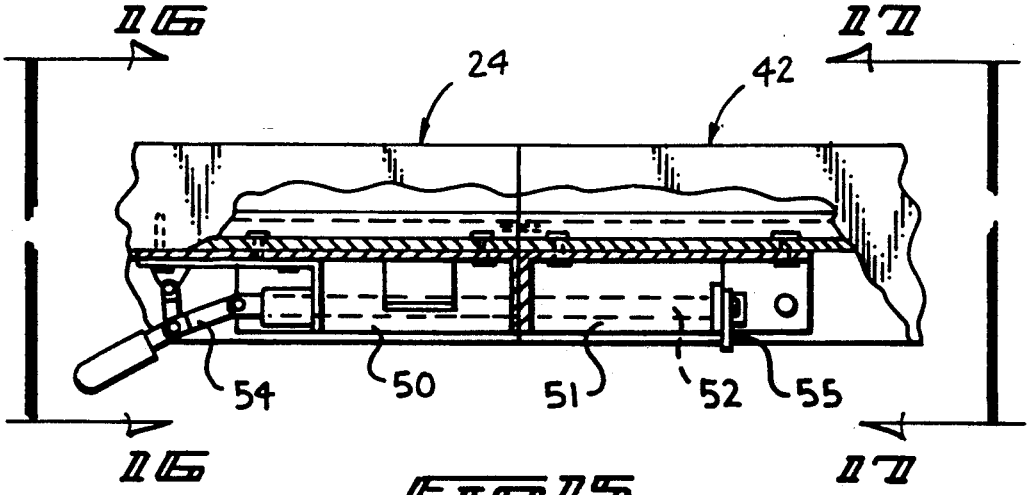
FIG. 15 is an orthographic side view of a modified guide track and further guide track structure arranged in an assembled configuration, partially in section.

More specifically, the platform lift apparatus 10 of the instant invention essentially comprises a base plate 11, including a first tube fixedly mounted to the base plate, with a second tube mounted to the first tube and a third tube mounted to the first tube, wherein the second tube and third tube are joined to the first tube to define an acute angle therebetween, and the first tube includes a first stabilizer leg 15 directed therethrough, with the second tube including a third stabilizer leg selectively secured to the second tube, and a fourth stabilizer leg 17 mounted selectively to the third tube 14. A respective third stabilizer leg latch 16*a* secures the third stabilizer leg to the second tube, with a fourth stabilizer leg latch 17*a* selectively securing the fourth stabilizer leg 17 within the third tube 14, as illustrated in FIG. 3. A first support leg 18 includes a first support leg swivel connection 18*a* mounted at a lower distal end of the first support leg pivotally mounting the first support leg to a forward terminal end of the third stabilizer leg. Similarly, a second support leg 19 including a second support leg swivel connection 19*a* pivotally mounts a lower distal end of the second support leg to a forward terminal end of the fourth stabilizer leg 17. It should be further noted the first stabilizer leg 15 includes a respective first and second leveling screw 15*a* and 15*b* orthogonally directed through the first stabilizer leg 15 adjacent opposed terminal ends thereof to effect leveling of the rigid first stabilizer leg 15. Similarly, a third and fourth leveling screw 22 and 23 respectively are directed adjacent the forward terminal ends of the third and fourth stabilizer leg 16 and 17 to effect selective leveling of the third and fourth stabilizer legs to provide for leveling of the apparatus in use.

A guide track 24 received within a guide track receiving socket 25 is arranged to define an acute angle between the guide track and the base plate 11 and canted forwardly relative to the base plate and fixedly joined to upper distal ends of the respective first and second support leg receiving tubes 20 and 21 telescopingly receiving the first and second support legs 18 and 19 therewithin. A linear gear rack 26 is mounted to a top surface of the guide track 26 and cooperative with drive gears 29 that are in turn driven through a drive motor 28 that in turn is mounted to a "U" shaped platform 27 arranged for movement along the guide track 24, with the guide track 24 received within a platform slot 30 medially through a forward edge of the platform. The drive motor also may include, such as illustrated optionally in the FIGS. 8 and 10 for example, a drive motor crank handle 29*a* operative to effect rotation of the drive motor to permit selective raising and lowering of the platform during periods of power failure, or where electrical current is not available to effect driving of the motor 28. An actuator lever 31 in cooperation with a further actuator lever 31*a* is provided and pivotally mounted relative to the platform 27 adjacent the slot 30 to permit selective actuation of the drive motor. The actuator lever 31 and the further actuator lever 31*a* are in cooperation with an actuator switch 32 and a further actuator switch 32*a* respectively to effect selective raising and lowering of the platform. Alternatively, a three-way switch may be utilized to include an "off", "first position", and a "second position" to permit the rotation and counter-rotation of the drive motor 28 to also afford selective raising and lowering of the platform 27. The platform 27 is arranged to include an extension flange 33 that is cooperative with at least one lower limit switch 34 mounted adjacent the base plate 11 to cease operation of the drive motor 28 and provide for a lower limit of travel of the platform 27. In a like manner, upper limit switches 35 are arranged and secured adjacent an upper terminal end of the guide track 24. It should be noted that the upper limit switches 35 should be arranged for adjustment in any conventional manner to utilize adhesives, mechanical fastening, and the like to permit adjustment and positioning of the upper limit switches relative to an upper terminal end of the guide plate in use and thereby provide for limiting of an upper extent of travel of the platform 27 for purposes of safety and convenience.

A "U" shaped abutment member 36 is mounted to the upper terminal end of the guide track 24 utilizing resilient tips projecting forwardly of the guide track and the associated first and second support leg receiving tubes 20 and 21 for abutment against such surface for proper positioning of the organization in use.

Further, a platform post 37 is arranged and mounted to the platform 27 extending upwardly therefrom and terminating in a platform post handle 38 permitting ease of securement by an individual. Further, a cushion pad 39 mounted within the "U" shaped handle 38 provides for a cushion surface for engagement by an individual in use.

Further, it should be noted that a platform 27 includes a guide roller 40 (see FIGS. 6–9 for example) arranged rotatably at the forward edge of the platform receiving the guide track 24 within the platform slot 30 and the platform guide roller 40 mounted at the entrance to the slot 30, as illustrated. Further, if desired, an actuator lever lock lever 41 mounted to the lever 31 and 31*a* is arranged for selective engagement with the gear rack 26 preventing inadvertent slippage of the platform when in a stabilized position. Rotation of the actuator levers 31 and 31*a* displace the lock lever relative to the gear rack 26.

The apparatus further includes, such as illustrated in the FIGS. 11–17, a guide track extension 42, including a guide track extension gear rack 43 that is aligned with the gear rack 26. The extension 42 is arranged for longitudinal alignment relative to the guide track 24 and includes an extension lower terminal flange 44 arranged for contiguous communication with a guide track upper terminal end flange 24*a* (see FIG. 12 for example). A locator pin 49 fixedly mounted to the extension lower terminal end flange 44 is received within the guide track upper terminal end flange 24*a* for proper alignment of the guide tracks together. A threaded rod 45 is fixedly mounted to a support gusset 46 such that the threaded rod 45 is arranged parallel to the guide track extension 42 and the guide track 24 projecting through the lower terminal end flange 44 and the guide track upper terminal end flange 24*a* directed through a threaded rod receiving tube 47 fixedly mounted to the guide track upper terminal end flange 24*a*, as well as the guide track 24. An internally threaded fastener 28 secured to the threaded rod 45 is in abutment with the receiving tube 47 and latches the guide track 24 to the guide track extension 42.

An alternative manner of securing the guide track 24 to the guide track extension 42 includes the use of a lock bolt 52 mounted to a toggle link 54 that in turn is through a guide track flange 50 mounted to the guide track 24 reciprocatable and arranged parallel to the gear racks 26 and 43, whereupon projection of the use of a lock bolt 52 mounted to the toggle link structure 54 projects the lock bolt 52 through a receiving flange 53 (see FIG. 17) whereupon a pivoted lock washer 55 is arranged to project the lock washer 55 within an annular groove (not shown) within the lock bolt and thereby lock the lock bolt 52 relative to the guide track extension 42.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A platform lift apparatus, comprising, a base plate, the base plate including a first tube fixedly mounted to the base plate, wherein the first tube includes a first stabilizer leg directed therethrough, and a second tube mounted to the base plate and to the first tube, and a third tube mounted to the base plate, the first tube, and the second tube, wherein the second tube and the third tube are joined at an acute included angle therebetween, and the second tube includes a second stabilizer leg and the third tube includes a third stabilizer leg, and a guide track fixedly mounted to the base plate adjacent the first tube, the second tube, and the third tube, with the guide track canted forwardly of the base plate and oriented medially of the second tube and the third tube, the guide track including a gear rack coextensive with the guide track and formed to a top surface thereof, and a platform mounted to the guide track, the platform including a drive motor, the drive motor including drive gears, the drive gears in cooperation with the gear rack, whereupon rotation of the drive motor and the drive gears displacement of the platform relative to the guide track is effected.

2. An apparatus as set forth in claim 1 wherein the first stabilizer leg includes a first leveling screw orthogonally directed through the first stabilizer leg adjacent a first terminal end thereof, and a second leveling screw orthogonally directed through the first stabilizer leg adjacent a second terminal end thereof, and the second stabilizer leg includes a third leveling screw orthogonally directed adjacent a forward terminal end of the second stabilizer leg, and the third stabilizer leg includes a fourth leveling screw orthogonally directed through a forward terminal end of the third stabilizer leg, and a first support leg includes a swivel connection formed at a lower distal end thereof, wherein the swivel connection is mounted to the forward terminal end of the second stabilizer leg, and a second support leg including a second support leg swivel connection mounted to a lower distal end of the second support leg, and wherein the support leg swivel connection is mounted to a forward distal end of the second stabilizer leg, the first support leg is received within a first support leg receiving tube, and the second support leg is received within a second support leg receiving tube, the first support leg receiving tube and the second support leg receiving tube include a respective first support leg receiving tube upper distal end and a second support leg upper distal end that are each fixedly joined to the guide track.

3. An apparatus as set forth in claim 2 wherein the platform includes a slot, and the slot receives the guide track therewithin, and a platform guide roller mounted at an entrance to the slot surrounds the guide track within the slot and the guide roller, wherein the guide roller is arranged for rotation relative to a bottom surface of the guide track, and the platform further includes at least one actuator lever pivotally mounted to the platform adjacent the slot, and the actuator lever includes an actuator switch with means and electrical communication with the drive motor for effecting selective raising and lowering of the platform.

4. An apparatus as set forth in claim 3 wherein the platform includes at least one platform extension flange extending below the platform, and a lower limit switch mounted to the base plate, wherein the lower limit switch is arranged in cooperation with the platform extension flange for effecting deactivation of the drive motor to limit a lowermost travel of the platform, and at least one upper limit switch adjustably mounted to the guide track for limiting uppermost of the platform.

5. An apparatus as set forth in claim 4 including a platform post fixedly mounted to the platform extending upwardly thereof, wherein the platform post terminates in a platform post handle for securement by an individual mounted on the platform.

6. An apparatus as set forth in claim 5 including an actuator lever lock rod fixedly mounted to the at least one actuator lever, wherein the actuator lever lock rod is arranged in selective engagement with the gear rack for engagement with the gear rack when the actuator lever is in a raised orientation relative to the switch means.

7. An apparatus as set forth in claim 6 including a guide track extension secured to the guide track longitudinally aligned with the guide track, wherein the guide track extension includes a guide track extension gear rack, wherein the guide track extension gear rack is aligned with the guide track gear rack.

8. An apparatus as set forth in claim 7 wherein the guide track extension includes a guide track extension lower terminal end flange, and wherein the guide track includes a guide track upper terminal end flange in contiguous communication with the guide track extension lower terminal end flange, and a locator pin fixedly mounted to the guide track extension lower terminal end flange received through the guide track upper terminal end flange to align a guide track to the guide track extension.

9. An apparatus as set forth in claim 8 including a threaded rod fixedly secured to the guide track extension below the guide track extension gear rack, and wherein the threaded rod is fixedly directed through the guide track extension lower terminal end flange and received through the guide track upper terminal end flange, and a threaded rod receiving tube is fixedly mounted to the guide track to receive the threaded rod therethrough, and an internally threaded fastener is secured to the threaded rod spaced from the guide track upper terminal end flange for contiguous communication with the threaded rod receiving tube to secure the threaded tube to the guide track, and the threaded rod is arranged in a parallel relationship relative to the guide track gear rack and the guide track extension gear rack.

* * * * *